US006497559B1

(12) United States Patent
Grant

(10) Patent No.: US 6,497,559 B1
(45) Date of Patent: Dec. 24, 2002

(54) MOLTEN METAL SUBMERSIBLE PUMP SYSTEM

(75) Inventor: Lloyd Grant, Bracebridge (CA)

(73) Assignee: Pyrotek, Inc., Spokane, WA (US)

( * ) Notice: Subject to any disclaimer, the term of this patent is extended or adjusted under 35 U.S.C. 154(b) by 0 days.

(21) Appl. No.: 09/520,937

(22) Filed: Mar. 8, 2000

(51) Int. Cl.[7] ..... F04B 17/00

(52) U.S. Cl. ..... 417/360; 417/423.3; 417/423.6; 266/239

(58) Field of Search ..... 417/360, 319, 417/53, 423.3, 423.6, 423.15, 424.1, 557; 415/88, 108, 175, 216.1, 200; 222/590, 595, 591, 630; 266/236, 239

(56) References Cited

U.S. PATENT DOCUMENTS 3,836,280 A * 9/1974 Koch ..... 415/175
5,181,828 A * 1/1993 Gilbert et al. ..... 415/200
5,622,481 A * 4/1997 Thut ..... 417/319
5,634,770 A * 6/1997 Gilbert et al. ..... 415/216.1
5,685,701 A * 11/1997 Chandler et al. ..... 417/424.1
5,716,195 A * 2/1998 Thut ..... 417/53
5,785,494 A * 7/1998 Vild et al. ..... 415/200
6,019,576 A * 2/2000 Thut ..... 415/200
6,293,759 B1 * 9/2001 Thut ..... 417/53

OTHER PUBLICATIONS

High Temperature Systems, Inc., Chipdog Series Aluminum Transfer & Circulation Pumps, 2001, High Temperature Systems Inc. of Chagrin Falls, Ohio,2 pages.*
High Temperature Systems, Inc., Bulldog Series Zinc Transfer & Circulation Pumps, 2001, High Temperature Systems Inc. of Chagrin Falls, Ohio,1 page.*
High Temperature Systems, Inc., 1997 TMS Annual Meeting: Exhibitor, 2001, High Temperature Systems Inc. of Chagrin Falls, Ohio,1 page.*

* cited by examiner

*Primary Examiner*—Charles G. Freay
*Assistant Examiner*—John F Belena
(74) *Attorney, Agent, or Firm*—Wells St. John P.S.

(57) ABSTRACT

Disclosed is a molten metal submersible pump system which includes a unitized body which acts as its own jig during assembly to precisely align the motor mount framework, the pump body, the pump base, and the pump shaft. Further disclosed is such a pump system which provides greater than normal surface area and heat sink mass, which has resulted in an increased useful life of the pump system between required maintenance and replacement of parts.

11 Claims, 7 Drawing Sheets

MOLTEN METAL SUBMERSIBLE PUMP SYSTEM

TECHNICAL FIELD

This invention pertains to a unitized body submersible pump system for use in pumping molten metal.

BACKGROUND OF THE INVENTION

Molten metal may be one of the more difficult environments in which to maintain a pump due to the heat and the corrosive factors within the molten metal. The submerged components of these pumps are typically made of graphite or similar materials due to the ability of these types of material compositions to withstand the heat and corrosive effects of the molten metal environment. While references may be made herein to molten aluminum, this is only used to give an example and not to limit the invention to aluminum pumps since the pump system disclosed herein may be used for pumping other molten metals.

Despite its positive properties for this application, graphite still corrodes and deteriorates over time and the pump must be maintained and replaced. The replacement or servicing of a pump operating submersed in molten metal is a time consuming exercise. First, the pump must first be removed from the molten metal, which causes down time of the metal furnace if that is the application. Then the pump along with the molten metal contained thereon must be allowed to sufficiently cool to allow it to be disassembled.

Once the deteriorated components are sufficiently cool, the molten metal built up on the various pump surfaces must be sufficiently removed to allow disassembly and/or re-use of the pump components. Then the pump must be re-assembled with the combination of old components or parts, along with the replacement parts. The downtime of a molten metal line may be as much as three to four days before it is operational again, which illustrates the importance of increasing the useful life of the pumps.

The useful life of a pump submersed varies greatly with the conditions of use, but it may be from twenty to sixty days for example.

The combination of the configuration and the number of components of typical prior art pumps make them difficult to efficiently and quickly assemble. A typical prior art pump is shown in FIG. 1, and includes a motor 2, a motor mount framework 3, a motor mount bracket 4, a rotating pump shaft 6 attached to an impeller housed in pump base 5, which is driven by the motor 2.

The prior art pump as shown in FIG. 1 further includes an output conduit which is formed in an output conduit body 7 (sometimes referred to as the riser tube), which is typically made of graphite and generally cylindrical with the internal conduit for the pumped molten metal to be pushed through by the impeller. The output conduit is placed through an aperture in the motor mount framework 3.

It is very important that motor 2, the shaft 6, the pump base 5 and the output conduit body 7 be accurately aligned in order for the pump system to work efficiently.

In the old or prior art way of providing a molten metal pump system, a special jig must be used to align the motor mount framework 3, the pump base 5, the pump shaft 6 and the output conduit body 7. The combination of the components is very heavy and because there are four components which must be accurately aligned and then secured to one another, substantial time must be taken to assemble the pump system in the precise manner required by the application. Hence the need for a jig to assemble the prior art pumps.

The four basic components of the prior art pump more or less form a parallelogram and it is important that it be a right angle type of parallelogram to enable the pump system, and especially the pump shaft 6 rotating the impeller in the pump base 5, to be accurately aligned.

It is therefore an object of this invention to provide a molten metal pump system which eliminates the need for using a separate jig to assemble or reassemble the pump components.

It is also an object of this invention to increase the useful life of the pump in the molten metal.

These objects and others are accomplished by this invention by the features more fully disclosed below, but including without limitation, the providing of an pump body which acts as the jig for the pump assemble, and which provides additional and differently configured graphite material around the output conduit, to increase the useful life of the pump.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Many of the fastening, connection, manufacturing and other means and components utilized in this invention are widely known and used in the field of the invention described, their exact nature or type is not necessary for an understanding and use of the invention by a person skilled in the art or science, and they will not therefore be discussed in significant detail. Furthermore, the various components shown or described herein for any specific application of this invention can be varied or altered as anticipated by this invention and the practice of a specific application of any element may already be widely known or used in the art, or by persons skilled in the art or science, and each will not therefore be discussed in significant detail.

The terms "a", "an" and "the" as used in the claims herein are used in conformance with longstanding claim drafting practice and interpretation and not in a limiting way. Unless specifically set forth herein, the aforementioned terms are not limited to one of such items but instead are intended to mean "at least one".

The pump body is preferably made of synthetic graphite, a man-made material which is made from petroleum coke for use in aluminum, an example of which may be grade CS114 available from Union Carbide.

Figure 1:
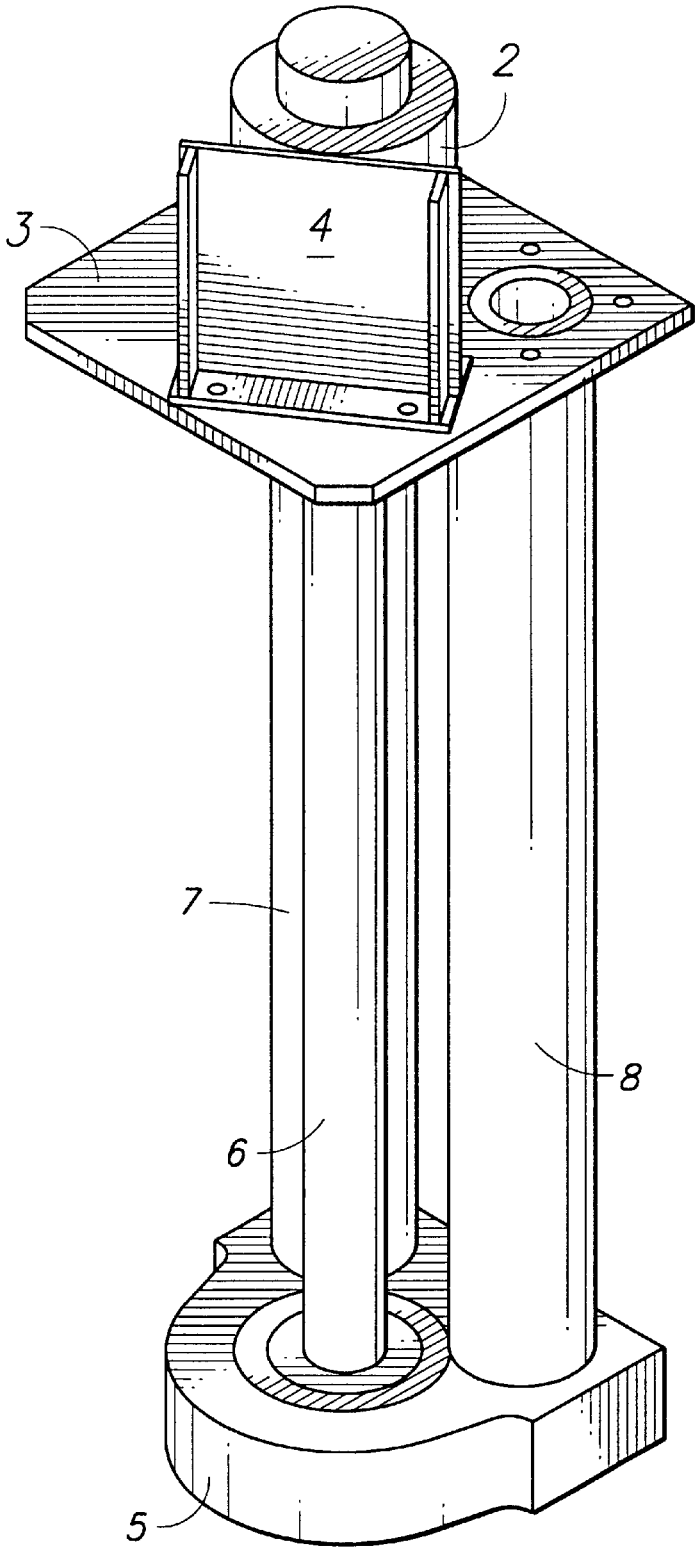
Fig 1 PRIOR ART
FIG. 1 is perspective view of a prior art pump.

FIG. 1 is a prior art pump and is more fully described above in the Background of the Invention Section.

Although the terms "front side", "back side", "top surface" and "bottom surface" are used herein, they are merely relative terms and meant for orientation on the device as identified. However, this does not mean or limit the invention to "top" being vertical top, but instead the invention may be utilized in any one of a number of different angles or orientations, all within the contemplation of this invention.

The term "alignment surface" is used herein with respect to the motor mount framework, the pump body (a first alignment surface and a second alignment surface) and the pump base. An "alignment surface" as used herein need not be on a single plane or on a plane at all, but is used more broadly to include any surface or which is intended to be partially or wholly mated with a corresponding alignment surface of a separate component. The alignment surface may also be one or more curved surfaces, all within the contemplation of this invention. The alignment surface need only be precisely formed to allow for the precise location of the motor mount framework, the pump body, the base and the shaft. The term "alignment surface" may also be and include three or more precise reference points which provide accurate reference points to position one component of the pump system relative to another.

When the term "the entire mount and alignment surface" is used herein, it refers to that amount of surface necessary to allow the components of the pump to be aligned relative to each other and securely mounted to one another, whether or not some additional surface or mounting structure is added cumulatively.

When it is referred to herein that an alignment surface is disposed to receive another surface or element, this not only means directly but indirectly as well. For instance placing intermediate components or elements between the two may be done within the contemplation of this term and this invention.

Figure 2:
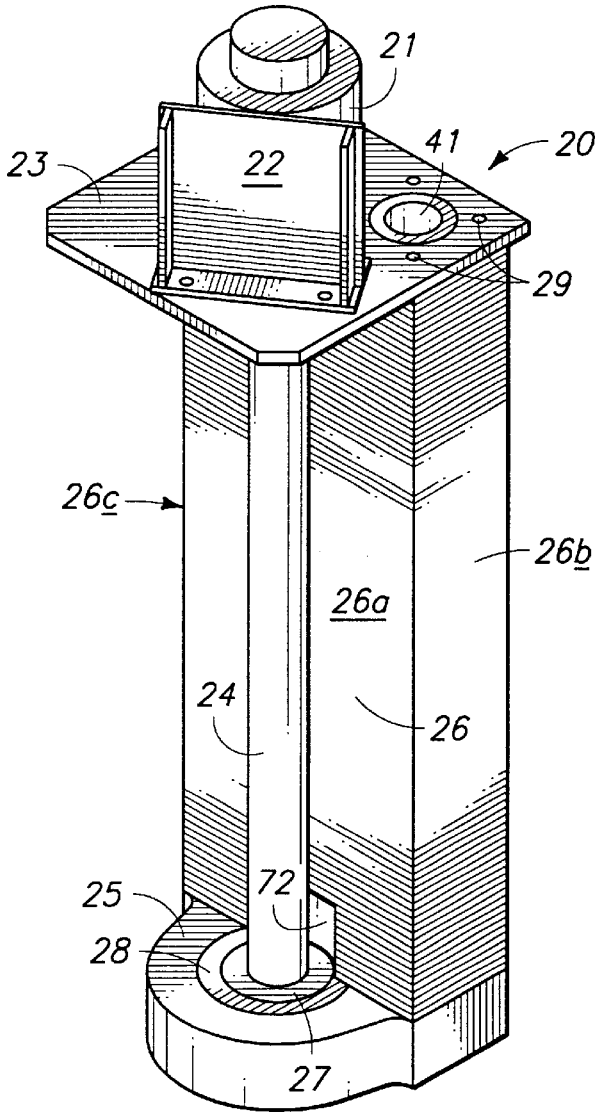
FIG. 2 is a perspective view of one embodiment of a pump system as contemplated by this invention.

FIG. 2 is a perspective view of one embodiment of a pump system as contemplated by this invention, illustrating a pump 20, pump motor 21, pump motor mount bracket 22, and pump motor mount framework 23. Pump motor mount framework 23 includes mount framework attachment apertures 29.

FIG. 2 illustrates the pump body 26, showing a first side 26*b,* a front side 26*a,* and a reference to a second side 26*c*. Pump shaft 24 is operatively connected or coupled to pump motor 21 to provide the operative rotation for the impeller 27 in the bearing ring 28. Pump body 26 includes a small indent 72 at the bottom portion to allow for operational and maintenance clearance for the impeller 27. The pump body 26 illustrated in FIG. 2 is a body structure.

Although the pump body 26 is shown in rectangular form, elongated top to bottom, there are a number of different shapes and configurations that the pump body 26 may have within the contemplation of this invention, these figures merely showing one embodiment, i.e. the preferred embodiment, as required. It will also be noted by those of ordinary skill in the art that the; pump body 26 is preferably made of one piece of material such as graphite, although it need not be to practice this invention as the term body as used herein is intended to also include structures, integral structures, multiple piece structures bound together, and the like, with no one in particular being required to practice this invention.

Figure 3:
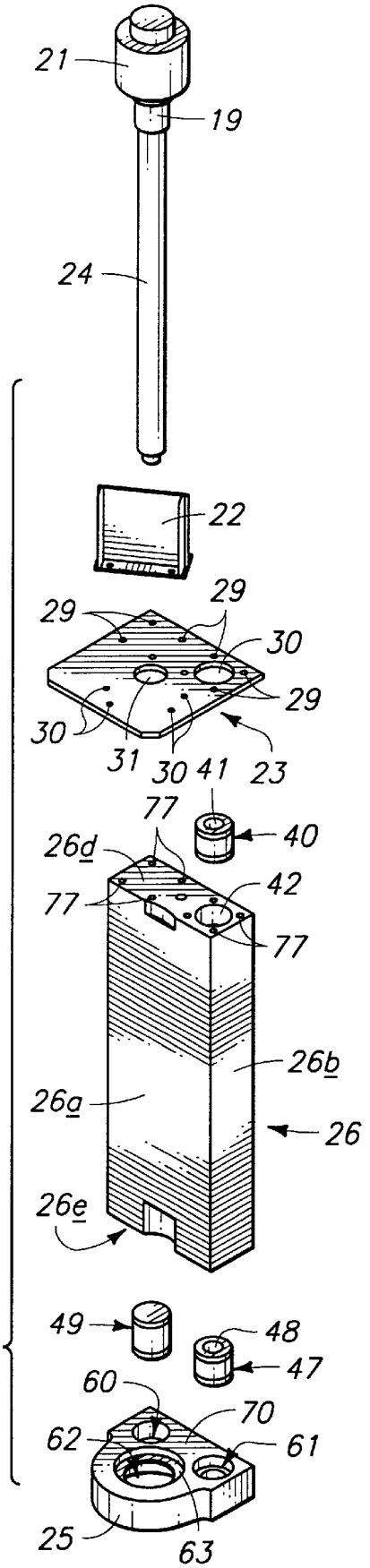
FIG. 3 is an exploded perspective view of one embodiment of a pump system as contemplated by this invention.

FIG. 3 is an exploded perspective view of the embodiment of the pump system as shown in FIG. 2. FIG. 3 illustrates pump motor 21, pump motor shaft coupling 19, pump shaft 24, motor mount bracket 22, and motor mount framework 23. FIG. 3 illustrates mount framework attachment apertures 29, mount framework motor shaft aperture 31 and mount framework conduit aperture 30. FIG. 3 also illustrates the mount framework bracket apertures 30 within motor mount framework 23.

The pump body 26 is illustrated with front side 26*a,* first side 26*b,* bottom surface 26*e,* and first alignment surface 26*d* at a first end of the pump body 26. First alignment surface 26*d* includes apertures 77 for receiving screws (not shown). These screws would be placed through mount framework attachment apertures 29 and received into apertures 77 to secure motor mount framework 23 to pump body 26.

The first alignment surface 26*d* of pump body 26 is typically milled by a vertical milling machine, and milled accurately to enable it to act as an alignment mechanism or reference on which to mount the mount framework; 23. By providing a precise first alignment surface 26*d* with a sufficiently broad or large surface area, the first alignment surface 26*d* combined with the motor mount framework 23 attached thereon act as a jig in prior art in achieving the alignment of the pump body 26, the pump shaft 24, the motor mount framework 23 and the pump base 25. Similarly, the bottom surface 26e at the second end of the pump body 26 is utilized in similar fashion in combination with the pump base alignment surface 70 of the pump base 25 to achieve said alignment and further assume property alignment in lieu of an assembly jig.

In the preferred embodiment illustrated in the drawings, the top surface 26*d* is the first alignment surface and the bottom surface is the second alignment surface, top and bottom merely being used for reference to the drawings.

In order to further assure alignment during assembly without the necessity of a jig, first alignment dowel 40 is provided with dowel aperture 41. First alignment dowel 40 closely fits within corresponding output conduit 42 to provide a close fit and an alignment means to align the motor mount framework 23 to the pump body 26. The dowel aperture 41 is preferably the same inner diameter as the output conduit 42, which means the aperture at the output end 42*b* (shown in FIG. 4) configured to receive the first alignment dowel 40 may be of larger inner diameter than the output conduit 42 to allow for the wall thickness of the first alignment dowel 40, to achieve approximate uniform inner diameter from the output conduit through the inner diameter of the first alignment dowel. 40.

A second alignment dowel 47 is provided for insertion into an alignment dowel aperture at the lower or bottom end of pump body 26 in similar fashion to first alignment dowel 40. Second alignment dowel 47 then snugly fits within first: dowel aperture 61 in pump base 25 to provide a source of alignment and positioning of the pump base 25 relative to the pump body 26.

Third alignment dowel 49 is also provided and snugly or closely fits within: second dowel aperture 60 in pump base 25 to provide further relative positioning and alignment between pump body 26 and pump base 25. There are corresponding apertures in the bottom portion of pump body 26 corresponding to the outer diameter of second alignment dowel 47 and to the outer diameter of the third alignment dowel 49, which receives the alignment dowels in similar and corresponding fashion to the first dowel aperture 61 and second dowel aperture 60.

Figure 10:
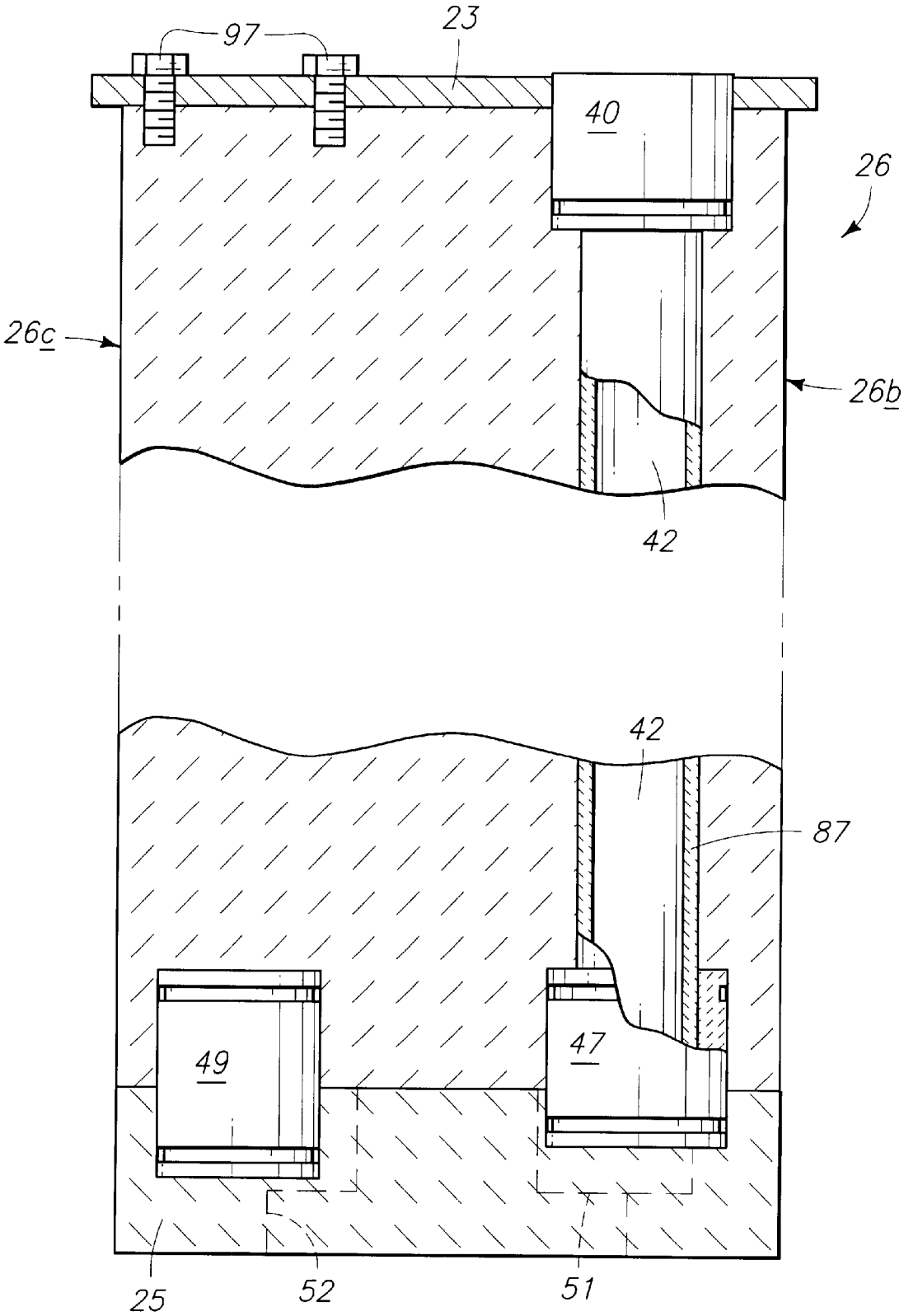
FIG. 10 is a partial section view of one embodiment of an pump body.

The output conduit 42 is preferably formed by placing or securing a tube 87 (as shown in FIG. 10) or pipe within the pump body 26. The tube 87 (as shown in FIG. 10) or pipe is preferably made of rigidized ceramic fiber paper glued to the inner surface of the aperture in the pump body and may be of any geometrical shape, with no one composition or geometrical shape being required to practice this invention.

FIG. 3 further illustrates bearing cavity 63 and impeller aperture 62, which are apertures and housings to provide and locate the impeller within pump base 25.

From the alignment and positioning utilization of the pump body 26, it can readily be seen by those of ordinary skill in the art how the pump body acts as a jig for the pump 20 during the assembly of the pump 20. Due to the configuration and use of the first alignment surface 26*d* of the pump body 20 and the bottom surface 26*e,* when combined with the motor mount framework 23 and the pump base 25, align the pump shaft 24, the impeller within the pump base 25 and the pump body 26 as the pump system is assembled. This is a substantial improvement over the parallelogram presented by prior art which required a specific alignment jig and which is much more cumbersome.

Figure 4:
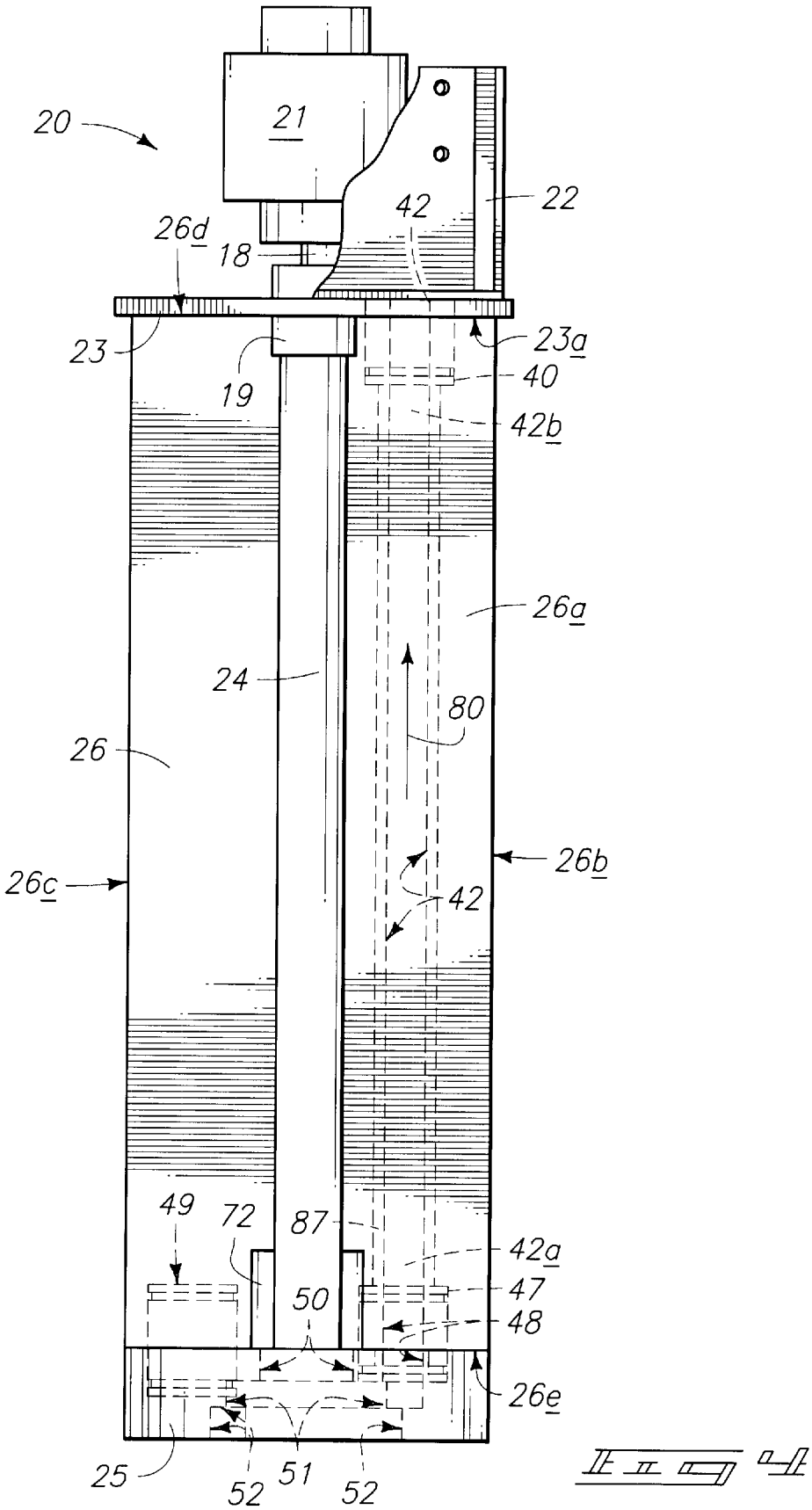
FIG. 4 is a front elevation view of the embodiment of the pump system as contemplated by this invention and as also shown in FIGS. 2 and 3.

FIG. 4 further illustrates the pump system 20, showing a front elevation view of the embodiment of the pump system 20 also illustrated in FIGS. 2 and 3. FIG. 4 illustrates pump motor 21, motor mount bracket 22, motor shaft 18, motor shaft coupling 19, pump shaft 24, pump body 26 with front side 26*a,* first side 26*b,* second side 26*c,* bottom surface 26*e* and first alignment surface 26*d.* FIG. 4 further illustrates motor mount framework 23, output conduit 42, first alignment dowel 40, second alignment dowel 47, third alignment dowel 49, and alignment dowel aperture 48, which is contiguous and of the same inner diameter as output conduit 42. FIG. 4 further shows pump body 26 with indent 72.

The output conduit 42 has an input end 42*a* and an output end 42*b,* the input end being disposed near the impeller and disposed to receive molten metal from an impeller for movement through the output conduit 42 to be discharged at the output end 42*b.*

Pump base 25 is shown with impeller housing 50 or cavity or aperture, pump volute 51, and bearing cavity or aperture 52 through which molten metal is drawn through the impeller and then pumped through output conduit 42 with arrow 80 showing the direction of flow of molten metal through output conduit 42.

Figure 5:
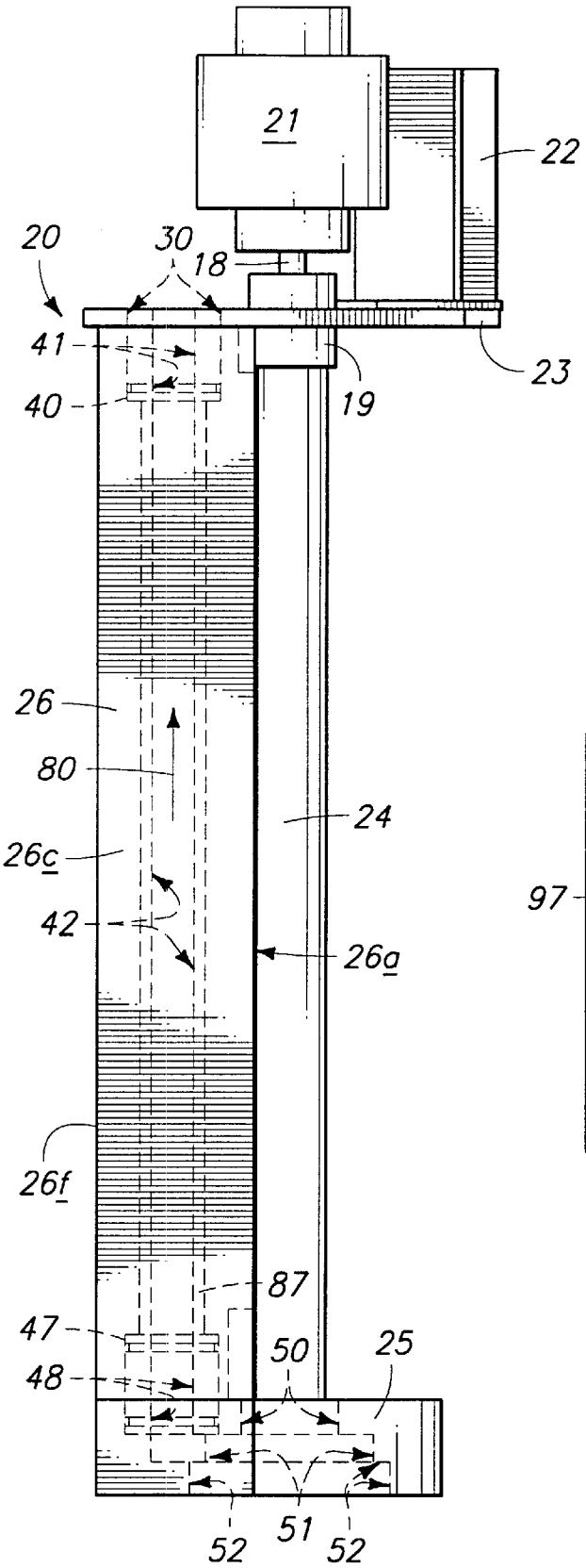
FIG. 5 is a first side elevation view of the embodiment of the pump system invention also shown in FIGS. 2 through 4.

FIG. 5 is a side view of the embodiment of the pump system 20 illustrated in prior figures. FIG. 5 illustrates motor 21, motor mount bracket 22, motor mount framework 23, motor shaft 18 and motor shaft coupling 19 coupled to pump shaft 24. FIG. 5 further illustrates pump body 26 with front side 26*a,* rear side 26*f* and second side 26*c*. Impeller housing 50, pump volute 51, and bearing cavity 52 are also shown in pump base 25.

Shown by hidden lines in FIG. 5 are output conduit 42 and second adjustment dowel 47 internal aperture 48 which in this embodiment, is the same internal diameter as output conduit 42. Further shown is mount framework conduit aperture 30 corresponding to the outer diameter of first alignment dowel 40. First alignment dowel 40 has internal dowel aperture 41 which is the same as the inner diameter of output conduit 42. Arrow 80 illustrates the direction of metal flow through output conduit 42.

Figure 6:
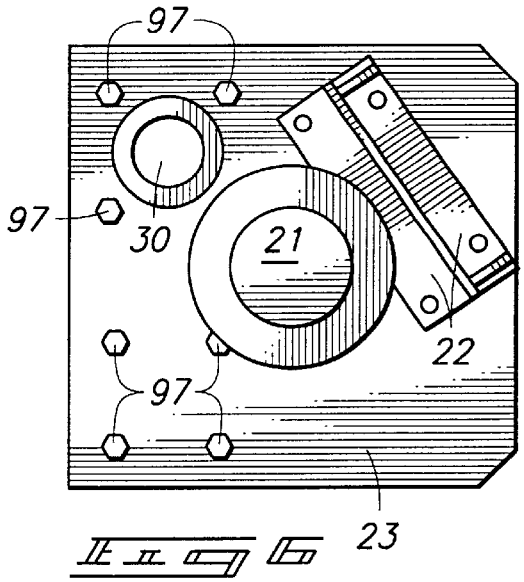
FIG. 6 is a top view of the embodiment of a pump system as contemplated by this invention and further shown in FIGS. 2 through 5.

FIG. 6 is a top view of the embodiment of this invention shown in prior figures and illustrates mount framework 23, pump motor 21, motor mount bracket 22, mount framework attachment screws 97, and mount framework conduit aperture 30.

Using the preferred apparatus as described above, an operator seeking to disassemble and then reassemble a pump for maintenance would remove the pump system 20 from within the molten metal and allow it to sufficiently cool down to allow work to be performed. The operator could then disassemble the pump system by removing the screws 97 holding the motor mount framework: 23 to the pump body 26 and disconnecting the pump shaft 24 from the motor 21 by disconnecting the coupling 19.

The impeller may be disconnected from pump shaft 24 and the pump base 25 removed or separated from pump body 26. A replacement pump shaft 24 and/or pump body 26 may then be reassembled into the pump system by providing pump base 25 with a alignment surface which provides precise alignment references. When the pump body 26 with a bottom surface 26*e,* with its precise alignment and locations, is combined with the pump base 25, the second alignment dowel 47 and the third alignment dowel 49 are placed within alignment dowel apertures in both the pump base 25 and in the pump body 26, as can be seen by those of ordinary skill in the art from FIGS. 2 through 7. This provides precise alignment and positioning of the pump body 26 relative to the pump base 25.

Then the motor mount framework 23 with its bottom surface 23*a* may be placed upon the first alignment surface 26*d* of the pump body 26, with both the bottom surface 23*a* and the first alignment surface 26*d* providing alignment references to accurately and precisely align the motor mount framework 23 to the pump body 26 via mount framework attachment apertures, first alignment dowel 40 and the corresponding holes or apertures in pump body 26 and the mount framework conduit aperture 30.

It can be seen that the creation of an accurate alignment reference on the first alignment surface 26*d* and the bottom surface 23*a* (the mount framework ⊎ignment surface) will act as a jig in the assembly of the pump system 20. Since the pump motor 21 is likewise located by mount framework motor shaft aperture 31 and motor mount bracket 22, the axis of the motor shaft 18 and the pump shaft 24 is precisely and accurately located, such that when all of the components are assembled and attached, they are accurately and precisely aligned for the efficient operation of the pump system with no jigs being required for assembly.

Similarly to the cooperation and relationship between pump base 25 and the bottom portion of pump body 26a, a first alignment dowel 40 may be used to accurately align and position motor mount framework 23 with respect to pump body 26, as first alignment dowel 40 would fit within mount framework conduit aperture 30.

It has also been found that the pump body 26 illustrated in the preferred embodiment as described above provides for a substantially longer useful life of the pump before corrosion occurs and the pump body needs to be replaced. It is believed that the additional surface area and the additional mass (and configuration/location of the mass) of the pump body 26 combine to reduce the corrosive effect of the molten metal on the material or composition of the pump body 26 (or its impact on the output conduit 42). It is also believed that due to the additional mass of the pump body, a heat sink is created which provides more efficient and effective flux from the outer surface to the output conduit 42, thereby reducing the stress on a thinner wall member and increasing the time it takes the corrosion to destroy the material between the outer surface of the pump body and the output conduit 42.

Figure 7:
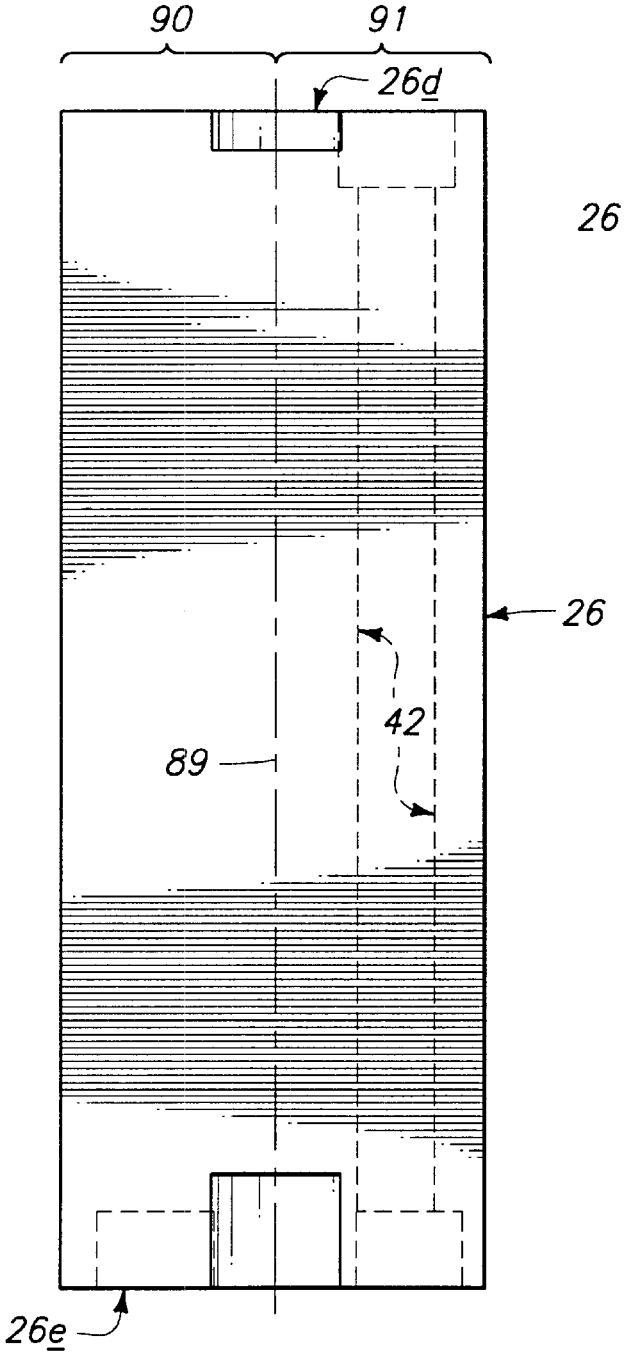
FIG. 7 is an elevation view of one embodiment of an pump body as contemplated by this invention.

FIG. 7 is an illustration of an embodiment of an pump body 26 and output conduit 42, as contemplated by this invention. Line 89 illustrates a transition portion of the pump body 26, showing a first section 91 and a second section 90. The first section 91 is the mass of the pump body which is adjacent to and generally surrounds the output conduit 42. Pump body portion 90 is a heat sink portion which in addition to providing the alignment and jig features as discussed above, provides additional mass which is believed to act as a heat sink and as a surface to absorb corrosive effects of the molten metal.

A sample size of a pump body 26 is thirty-one inches tall, eleven inches wide and four and one-half inches thick or deep. In a case of such dimensions, the pump base may be approximately eleven inches wide, two and three-quarter inches high and approximately ten inches wide or deep from the front portion thereof to the rear portion.

Figure 8:
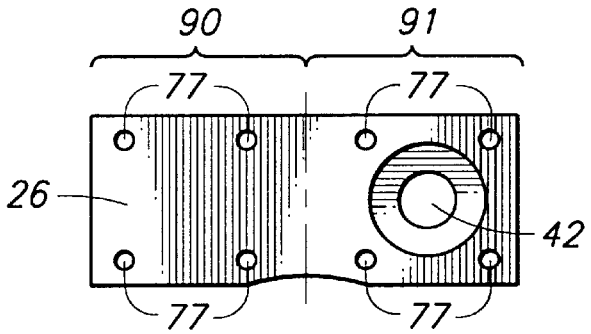
FIG. 8 is a top view of one embodiment of an pump body as contemplated by this invention.

FIG. 8 is a top view of the pump body 26 as shown in FIG. 7 and also shows output conduit 42, apertures 77 for receiving screws to attach mount framework 23 to pump body 26, heat sink portion 91, and output conduit portion 90. It will be noted from FIGS. 7 and 8 that this new configuration of pump body 26 is not symmetrical around output conduit 42 and provides a heat sink and/or mass that is not symmetrical about or around output conduit 42.

Figure 9:
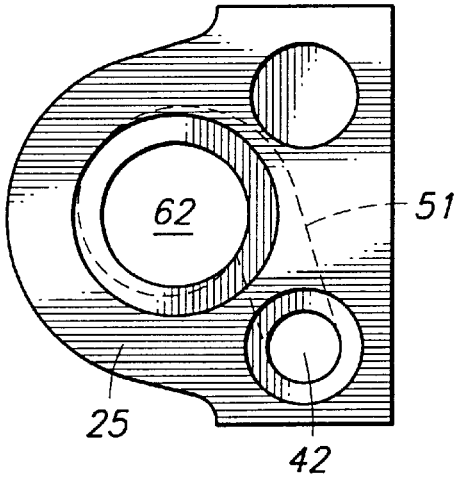
FIG. 9 is a top view of one embodiment of a pump base as contemplated by this invention.

FIG. 9 is a top view of pump base 25, showing a pump volute 51 from impeller aperture 62 to output conduit 42, which illustrates the path through which the impeller would push molten metal from the impeller aperture 62 up and through output conduit 42.

FIG. 10 illustrates one embodiment of an pump body 26 as contemplated by this invention, showing a partial rear section cutaway view, illustrating first side 26*b*, second side 26*c*, and the motor mount framework 23 mounted on the pump body 26 via screws 97 which project through the mount framework attachment apertures and into the top portion of pump body 26.

FIG. 10 illustrates first alignment dowel 40, output conduit 42, second alignment dowel 47 and third alignment dowel 49 with pump body 26. The pump base 25 is shown with bearing cavity or aperture 52 and further shows the pump volute 51 or path through which molten metal is pumped by the impeller to push it up and through output conduit 42.

Figure 11:
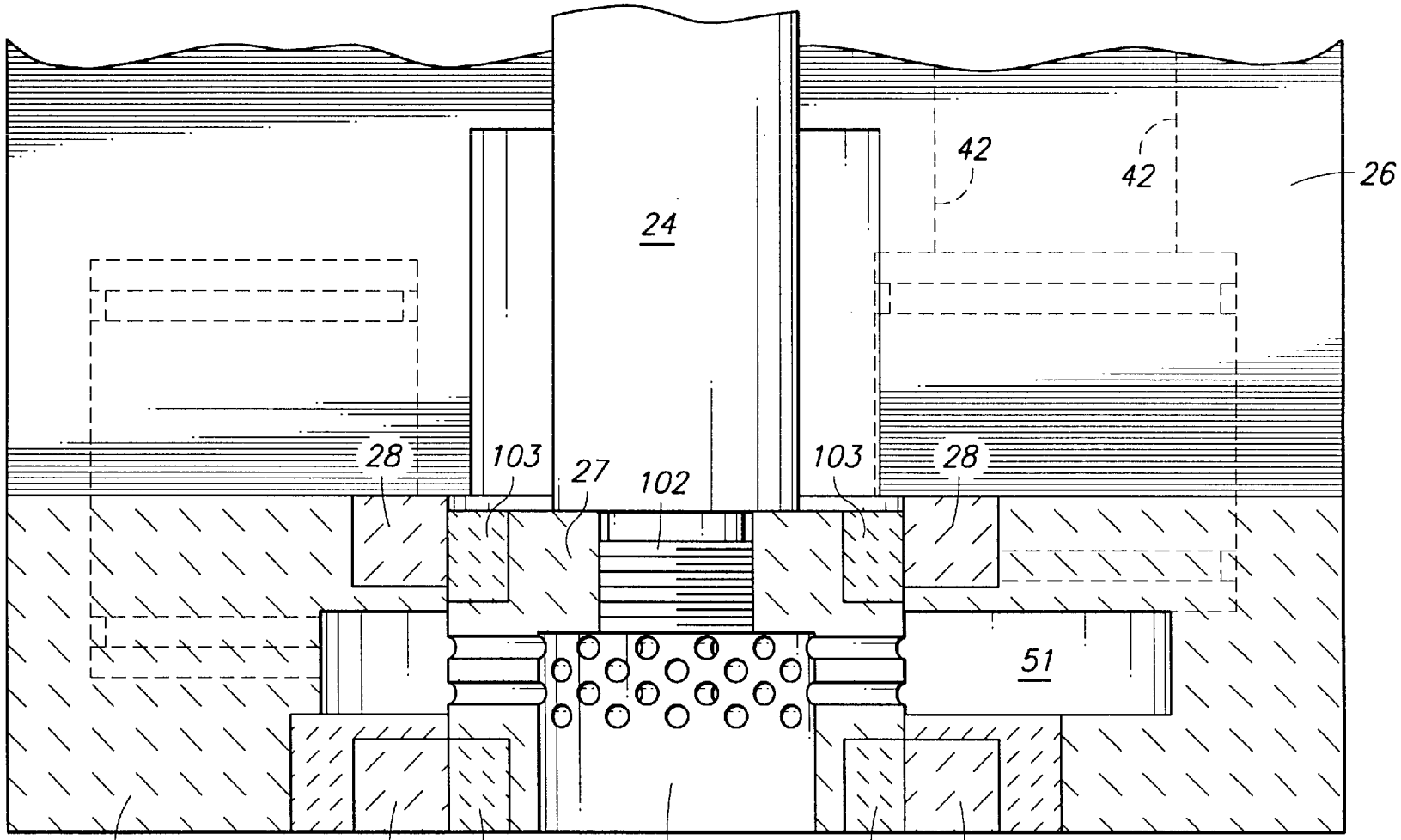
FIG. 11 is an elevation view of the lower portion of the pump body, the base and illustrates the impeller.

FIG. 11 is an elevation detail of the lower portion of the pump body 26 and the pump base 25, and illustrates the impeller 27 housed within the pump base 25. FIG. 11 also illustrates pump volute 51, bearing 101, impeller wear surface 103, bearing 28, internal threads 102 in the impeller 27 for receiving external threads on the pump shaft 24. Output conduit 42 is shown disposed to receive molten metal from pump volute 51.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A pump body for use in aligning and assembling a submersible molten metal pump, the molten metal pump including a pump motor mount framework which has a mount framework alignment surface, a pump shaft, and a pump base which has a base alignment surface, the pump body comprising:

(a) a body structure;

(b) a first alignment surface on the body structure, the first alignment surface corresponding to the mount framework alignment surface and disposed to receive the pump motor mount framework mounted thereon;

(c) a second alignment surface on the body structure, the second alignment surface corresponding to the base alignment surface and disposed to be mounted on the base alignment surface;

(d) an output conduit within the body structure, the output conduit having an input end and an output end, the input end being disposed to receive molten metal and the output end being disposed to discharge molten metal;

wherein the first alignment surface operably attached to the corresponding mount framework alignment surface, and the second alignment surface operably attached to the corresponding base alignment surface, provide the entire alignment for assembling the molten metal pump.

2. An pump body as recited in claim 1, the pump body structure further comprising an output conduit portion and a heat sink portion integral with, but spaced apart from, the output conduit portion.

3. An pump body as recited in claim 1, the pump body structure further comprising one or more dowel apertures disposed to receive one or more alignment dowels which may be placed in corresponding dowel apertures in the pump base.

4. An pump body as recited in claim 1, the pump body structure further comprising one or more dowel apertures disposed to receive one or more alignment dowels which may be placed in corresponding dowel apertures in the motor mount framework.

5. A submersible molten metal pump comprised of:

(a) a pump motor with a motor mount framework, the motor mount framework including a mount framework alignment surface;

(b) a pump body on which the pump motor is mounted, the pump body comprised of:

(i) a body structure with a first end and a second end;

(ii) a first alignment surface on the body structure, the first alignment surface corresponding to the mount framework alignment surface and disposed to have the pump motor mount framework mounted thereon;

(iii) a second alignment surface on the body structure;

(iv) an output conduit within the body structure, the output conduit having an input end and an output end, the input end being disposed to receive molten metal and the output end being disposed to discharge molten metal;

wherein the first alignment surface operably attached to the corresponding mount framework alignment surface, and the second alignment surface operably attached to the corresponding base alignment surface, provide the entire alignment for assembling the molten metal pump;

(c) a pump shaft operatively coupled with the pump motor; and (d) a pump base with a base alignment surface, the base alignment surface corresponding to the second alignment surface of the pump body and on which the pump body mounts.

6. A submersible molten metal pump as recited in claim 5, and wherein the pump body includes one or more dowel apertures corresponding to and opposing one or more dowel apertures in the pump base, and which further comprises one or more alignment dowels for insertion into the corresponding and opposing dowel apertures in the pump body and the pump base.

7. A submersible molten metal pump as recited in claim 5, and wherein the pump body includes one or more dowel apertures corresponding to and opposing one or more dowel apertures in the motor mount framework, and which further comprises one or more alignment dowels for insertion into the corresponding and opposing dowel apertures in the pump body and the motor mount framework.

8. A submersible molten metal pump as recited in claim 5, and in which the pump body structure is further comprised of an output conduit portion and a heat sink portion integral with, but spaced apart from, the output conduit portion.

9. A method for assembling a submersible molten metal pump, comprising the following steps:

(a) providing a motor mount framework which includes a mount framework alignment surface;

(b) providing a pump motor mounted to the motor mount framework, the motor including a motor shaft;

(c) providing a pump body which includes an output conduit; a first alignment surface corresponding to the mount framework alignment surface, and a second alignment surface;

(d) providing a pump shaft for operative coupling to the motor shaft;

(e) providing a pump base which includes: a pump shaft aperture, an impeller housing, and a base alignment surface which corresponds to the second alignment surface of the pump body and on which the pump body mounts (f) mounting the motor mount framework to the pump body at the corresponding mount framework alignment surface and first alignment surface of the pump body;

(g) coupling the pump shaft to the motor shaft; and (h) mounting the pump body to the pump base at the corresponding base alignment surface and the second alignment surface of the pump body.

10. A method for assembling a submersible molten metal pump as recited in claim 9, and further comprising the steps of:

providing the pump body and the pump base with one or more corresponding dowel apertures, and further providing one or more alignment dowels which are disposed to be snugly received in the dowel apertures, and inserting the one or more alignment dowels in the one or more corresponding dowel apertures in the pump body and the pump base, thereby aligning the pump body and the pump base.

11. A method for making a pump body for use in aligning and assembling a pump motor mount framework which has a mount framework alignment surface, a pump shaft, and a pump base which has a base alignment surface, for use in a submersible molten metal pump, comprising the following steps:

(a) providing a body structure;

(b) creating a first alignment surface on the body structure, the first alignment surface corresponding to the mount framework alignment surface and disposed to receive the pump motor mount framework mounted thereon;

(c) creating a second alignment surface on the body structure, the second alignment surface corresponding to the base alignment surface and disposed to be mounted on the base alignment surface;

(d) creating an output conduit in the body structure with an input end disposed to receive molten metal and with an output end disposed to discharge molten metal; and wherein the first alignment surface operably attached to the corresponding mount framework alignment surface, and the second alignment surface operably attached to the corresponding base alignment surface, provide the entire alignment for assembling the molten metal pump.

* * * * *

UNITED STATES PATENT AND TRADEMARK OFFICE

CERTIFICATE OF CORRECTION

PATENT NO. : 6,497,559 B1
DATED : December 24, 2002
INVENTOR(S) : Lloyd Grant

It is certified that error appears in the above-identified patent and that said Letters Patent is hereby corrected as shown below:

Column 2,
Line 18, change “an pump body” to -- a pump body --.
Lines 44, 46 and 50, in all three instances change “an pump body” to -- a pump body --.

Column 6,
Line 48, change “±ignment” to -- alignment --.

Column 7,
Lines 11 and 42, in both instances change “an pump body” to -- a pump body --.

Column 8,
Lines 35, 39 and 44, in all instances change “an pump body” to -- a pump body --.

Signed and Sealed this

Fifth Day of August, 2003

JAMES E. ROGAN
*Director of the United States Patent and Trademark Office*